US005820529A

United States Patent [19]

Weintraub

[11] Patent Number: 5,820,529

[45] Date of Patent: Oct. 13, 1998

[54] DUAL OPERATIONAL EXERCISE RESISTANCE DEVICE

[75] Inventor: Mitchell Weintraub, 1131 Arlanie Rd., Brooksville, Fla. 34609

[73] Assignee: Mitchell Weintraub, Brooksville, Fla.

[21] Appl. No.: 840,610

[22] Filed: Apr. 25, 1997

[51] Int. Cl.[6] ..... A63B 21/04

[52] U.S. Cl. ..... 482/92; 482/129; 482/904

[58] Field of Search ..... 482/112, 113, 482/121, 128, 129, 130, 138, 904, 97, 99.92, 102, 103

[56] References Cited

U.S. PATENT DOCUMENTS

| | | | |
|---|---|---|---|
| 848,272 | 3/1907 | Thornley | 482/102 |
| 4,988,095 | 1/1991 | Ferrari | 482/102 |

*Primary Examiner*—Richard J. Apley
*Assistant Examiner*—John Mulcahy

[57] ABSTRACT

A dual operational exercise resistance device that is usable in the home or fitness center by attachment to a supporting structure. The supporting structure can be a freestanding platform base, a wall, or a door. The device can be utilized to replace the weight stack in a universal gym or any exercise machine. The device can be utilized to provide resistance from more than one point of attachment for standard exercise grips. In addition the resistance provided by the device is easily adjustable, providing the appropriate resistance for the particular muscle group being exercised. The device comprises a base that is configured for attachment to a support or exercise machine, a lever arm member having a peripheral edge being pivotally attached to the base having a pulley on end, two pulleys on opposite ends of the base being pivotally mounted on a horizontal axis within vertically orientated mounted brackets and a pulley being pivotally attached to an intermediate point on the base. One end of the lever arm member is attached to a pivotally mounted pulley to which a portion is engaged by a cable and extends therefrom in two directions for attachment to a grip at two alternate locations. To the other end of the bar attached a resistance mechanism that attaches pivotally to an intermediate point on the base. This structure reduces the resistance force produced by the resistance mechanism as the exerciser approaches full contraction of the muscle group being exercised to insure a completely full contraction is made. The device also compensates for the use of a non-linear resistance mechanism.

5 Claims, 8 Drawing Sheets

DUAL OPERATIONAL EXERCISE RESISTANCE DEVICE

FIELD OF THE INVENTION

The present invention relates exercisers, and more particularly to exercise resistance devices which are portable, smaller, lightweight and offer alternate points for resistance from a single source of resistance.

DESCRIPTION OF THE PRIOR ART

Exercising the muscles of the body to increase the strength, muscle size and fitness of an individual by lifting free weights or by using a system of cables and pulleys to lift weights is well known in the art. It was found that free weights were cumbersome, created storage problems, can be noisy, damaging to floors and walls, and are heavy limiting portability and increasing shipping cost. The development of devices that used springs or elastic bands to provide the resistance to muscle contraction eliminated the problems inherent with handling heavy weights, but created new problems and were limited to one point of resistance further limiting versatility in types of exercises capable of being performed. Such devices include U.S. Pat. No. 679,784 and U.S. Pat. No. 689,418, both issued to M. B. Ryan, U.S. Pat. No. 1,237,588 issued to T. E. Vaughn, U.S. Pat. No. 4,072,308 issued to L. T. Applegate, U.S. Pat. No. 4,709,920 issued to J. Schnell, U.S. Pat. No. 5,050,869 issued to R. A. Frate, and U.S. Pat. No. 5,601,518 issued to M. Weintraub. The exerciser's strength varies as the leverage across the joints through the various positions of muscle flexion; being relatively weak at full extension, at or near peak contractile capability at the mid-range position of flexion and weaker as complete contraction is approached. During an exercise workout the larger the range of motion traversed by the muscle being trained and the greater the amount of variety of exercises performed during the workout the larger the potential stimulation for growth to occur in the muscle. Failure to make a thoroughly complete contraction during training and lack of exercise variety leads to improper and asymmetrical muscle development. Asymmetrical development can become a limiting factor in additional muscle growth and development. When the exerciser approaches full contraction and is working against the same or increased resistance, the exerciser is often incapable or frequently discouraged from making a thoroughly complete contraction. Larger, more bulky, heavy, non-portable, exercising apparatus are able to compensate for the reduced strength as complete contraction is approached to ensure a complete contraction is obtained by the exerciser. Utilizing several pieces of equipment may insure that a variety of exercises can be performed; however, the single devices which are smaller, more portable exercise and resistance devices known today which compensate for decreased muscle strength or non-linear resistance devices, are unable to offer alternate points of resistance, so that users of these types of equipment are not capable of performing a large variety of upper and lower body exercises in order to obtain proper muscle development and symmetry.

The amount of resistance provided by exercise devices that use springs and elastic bands normally do not offer a large range of resistance forces. A narrow range of resistance will limit some muscle groups from being trained properly. The present day devices are not easily adjustable and offer a single attachment point for exercise grips. A single attachment point makes it difficult to perform upper and lower body exercises with a single piece of equipment. Also, as the exerciser's strength increases, progressive resistance is required in order to continue improved development.

Therefore, not withstanding the existence of such prior art exercise apparatus, it remains clear that there is a need for a dual operational exercise resistance device that utilizes the less bulky elastic bands or springs, is lightweight, can be portable, offers at least two points of attachment for exercise grips, provides a means for compensating for the changes in muscle strength as the exerciser moves through the positions of flexion, can replace ordinary weight stacks in exercise machine apparatus, can compensate for the increased resistance as the band or spring stretches or compresses, and provides a means for easily adjusting the resistance.

SUMMARY OF THE INVENTION

The present invention relates to a dual operational exercise resistance device that uses a biasing means to provide the opposing force. The biasing means can be acted upon from at least two points of attachment. The exercise device compensates for varying muscle strength as the exerciser moves through the positions of flexion during an exercise, and can compensate for the increased resistance that occurs as the biasing means is extended. The amount of resistance produced from the exercise device is easily adjustable. Most simply stated, the exercise device of this invention comprises a unit base with vertical orientation, which has a first end, the upper end, and has a second end, the lower end, which is collapsible and is configured for attachment to a support means generally a wall, door or floor platform. A pulley is pivotally attached to the unit base. A bar, having first and second ends, is pivotally attached at a pivot point, that lies intermediate the first and second ends of the bar, to the opposite end of the unit base. The bar defined as the lever-arm is comprised of two parts, a first part is defined as that portion of the bar that extends from the pivot point to and including the first end of the bar and a second part is defined as that portion of the bar that extends from the pivot point to and including the second end of the bar. Attached to the first end of the bar is a pivotally attached pulley defined as the lever-arm pulley.

Attached at the first end and second end of the unit base are horizontal axis pulley's. The pulley's are mounted to a U-shaped bracket pivotally attached vertically to secondary U-shaped bracket with rigid attachment to the unit base.

The first end of a longitudinal cable of specific length extends from the first end, to the upper horizontal axis pulley to the vertically aligned unit base pulley, to the lever-arm pulley, to the lower, second end horizontal axis pulley, to finally the second end of the longitudinal cable. A longitudinally extending biasing means has a first end pivotally attached to an intermediate location on the unit base, and a second end attached to the second end of the lever arm member.

As will be described in greater detail below, as the first or second end of the longitudinal cable is pulled, the lever arm member pivots so that the cable pulls on the first end lever-arm pulley rotating the lever arm member about the pivot point. As the lever arm member rotates about the pivot point, the biasing means stretches providing resistance to the rotation of the lever arm member, and thus, resistance to the movement of the first or second end of the longitudinal cable. When the longitudinal cable is released, the biasing means retracts and the lever arm member pivots toward its original position. By pulling on the longitudinal cable, the exerciser's muscles are worked as the exerciser pulls against the resistance of the biasing means. Moving the point of attachment of the second end of the biasing means from the second end of the bar toward the pivot point will shorten the moment arm, increasing the resistance, while moving the point of attachment toward the second end of the lever arm member will increase the moment arm, decreasing the resistance. A greater range of resistance may be gained with the use of several biasing means or the use of singular biasing means of greater resistance.

Accordingly, the invention comprises an article of manufacture possessing the features, properties, and the relation of elements which will be exemplified in the article hereinafter described, and the scope of the invention will be indicated in the claims.

BRIEF DESCRIPTION OF THE DRAWINGS

For a full understanding of the nature and objects of the invention, reference should be had to the following detailed description of drawings, in which.

DETAILED DESCRIPTION

Figure 7:
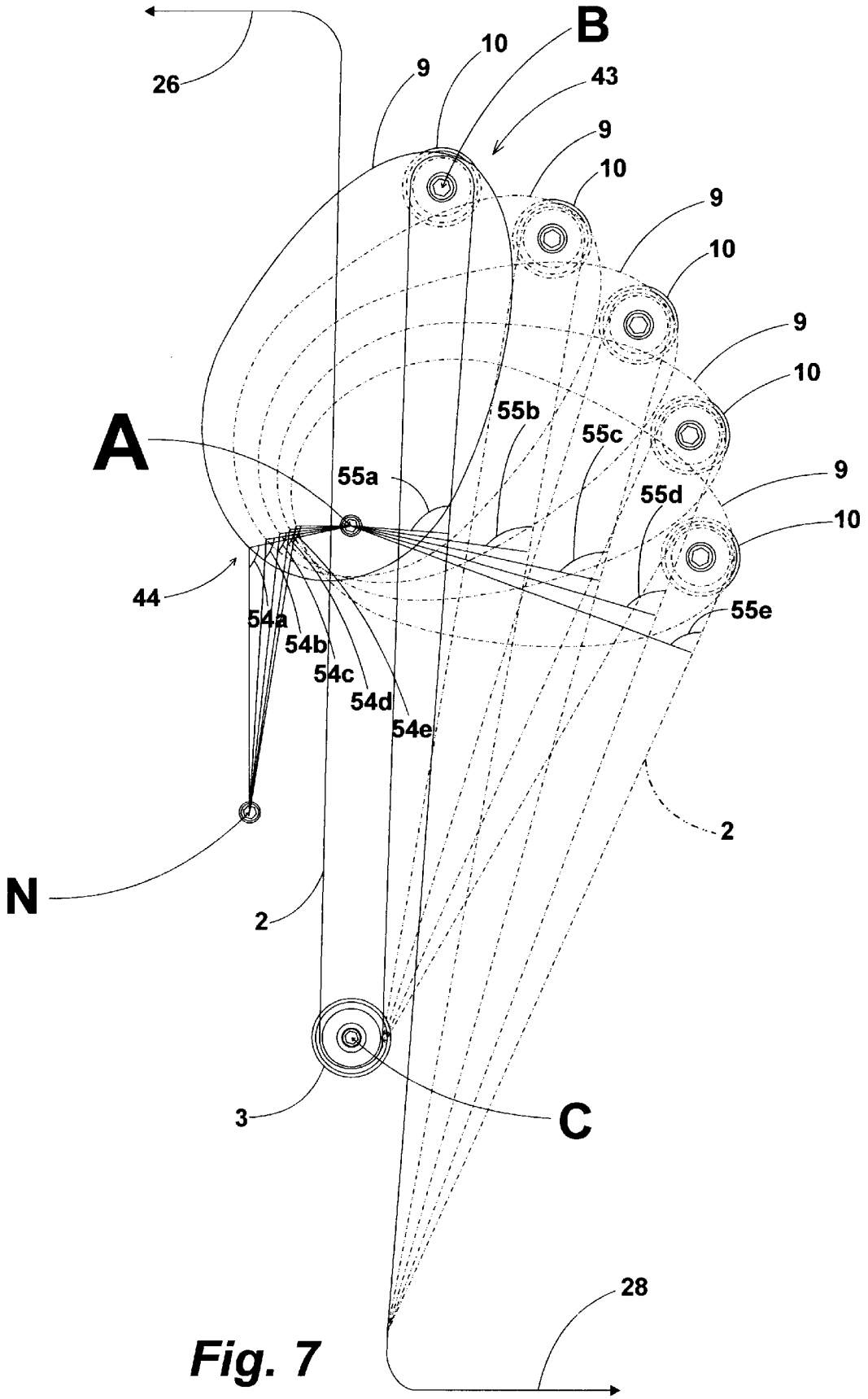
FIG. 7 is a graphical representation of the lever arm member of the invention as it pivots from the setup position to the fully extended position, illustrating the changes to the moment arms as the lever-arm pivots.
Figure 8:
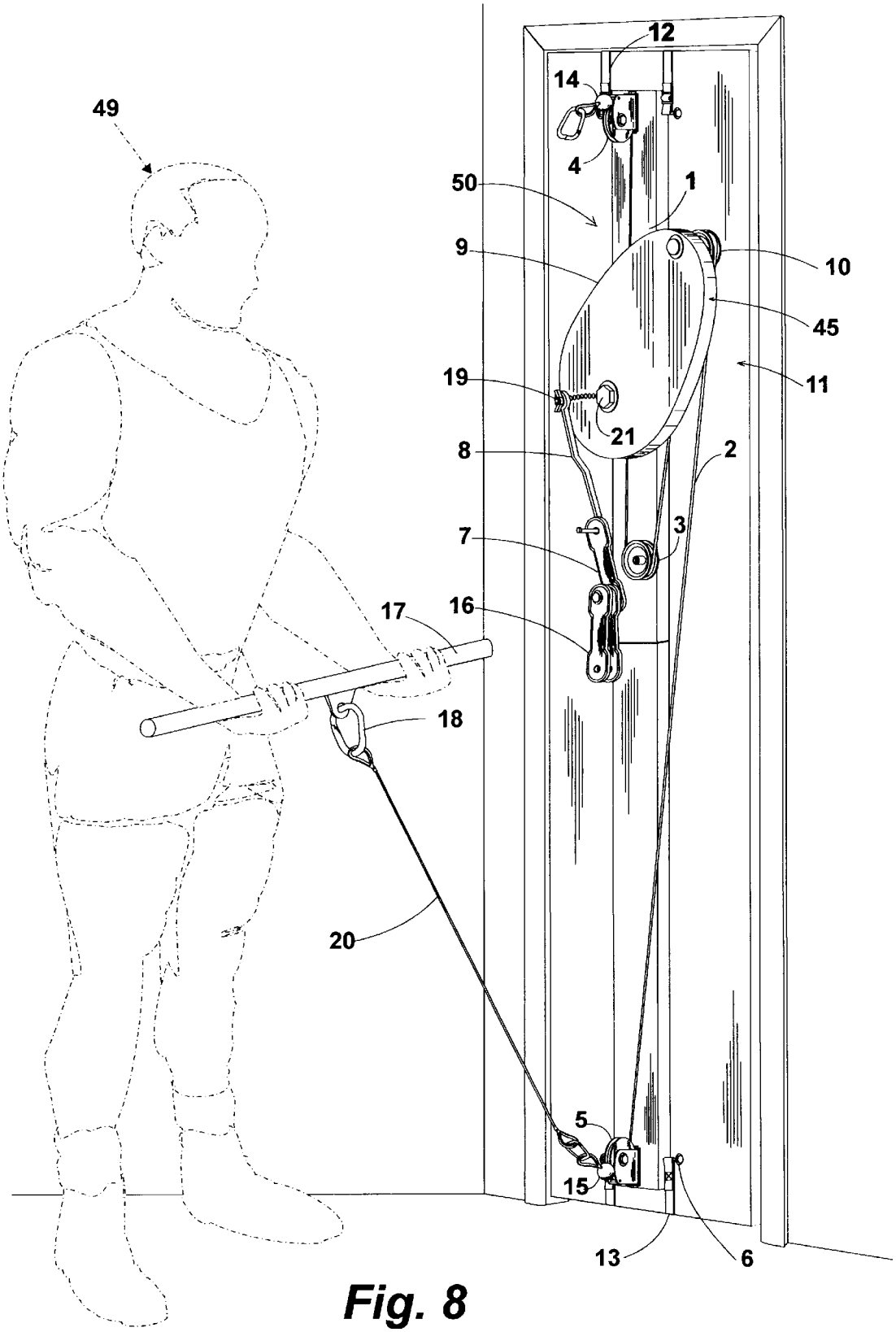
FIG. 8 is a perspective view of the invention of FIG. 1 illustrating the device in use.

A preferred embodiment for the exercise device of this invention is illustrated in the drawing FIGS. 1–8. The exercise device is generally indicated as 50 in the views of FIGS. 1–5, and 8. The device is illustrated in FIGS. 1–4, and 8 being installed on a door 11. FIG. 8 illustrates an exerciser 49 shown in phantom operating the device 50 while it is installed on a door 11. Referring first to the view of FIG. 1, it can be seen that the exercise device 50 comprises a unit base, shown generally as 1, a lever-arm member 9, a unit base pulley shown generally as 3, a longitudinally extending biasing means 7, a longitudinally extended cable 2, a lever-arm member pulley 10, a first end upper horizontal axis pulley 4, a second end lower horizontal axis pulley 5, a first end pulley bracket 31, a second end pulley bracket 32, a first end U-bracket 27, a second end U-bracket 29, a first end cable stop 14 and a second end cable stop 15.

The unit base is comprised of a unit base 1, having a front surface, a first end surface K, a second end surface L, a first end door strap bracket 12 and a second end door strap bracket 13. In a preferred embodiment the strap brackets 12 and 13 would be used to attach strapping with a connection device such as a strapping buckle 22 to attach to doors of any dimension or walls, and said second end surface L, having an unit base aperture 40, will serve as the receptacle to any male connection sleeve integrated for attachment to other support means, including but not limited to a bench, wall, universal cable crossover or floor platform.

Figure 2:
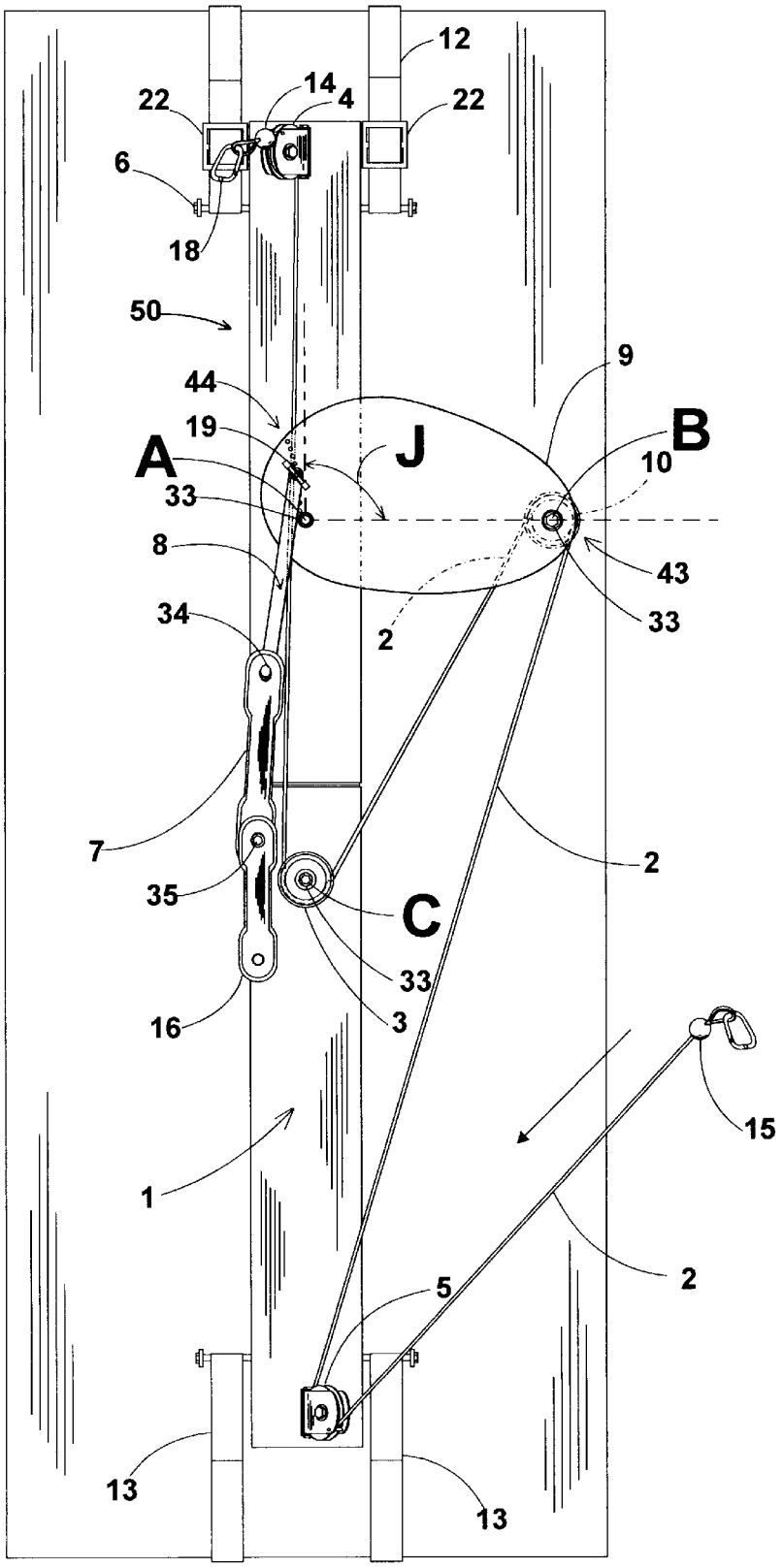
FIG. 2 is the apparatus of the invention of FIG. 1 illustrating the invention in the fully extended position of the first end of the longitudinal cable.
Figure 3:
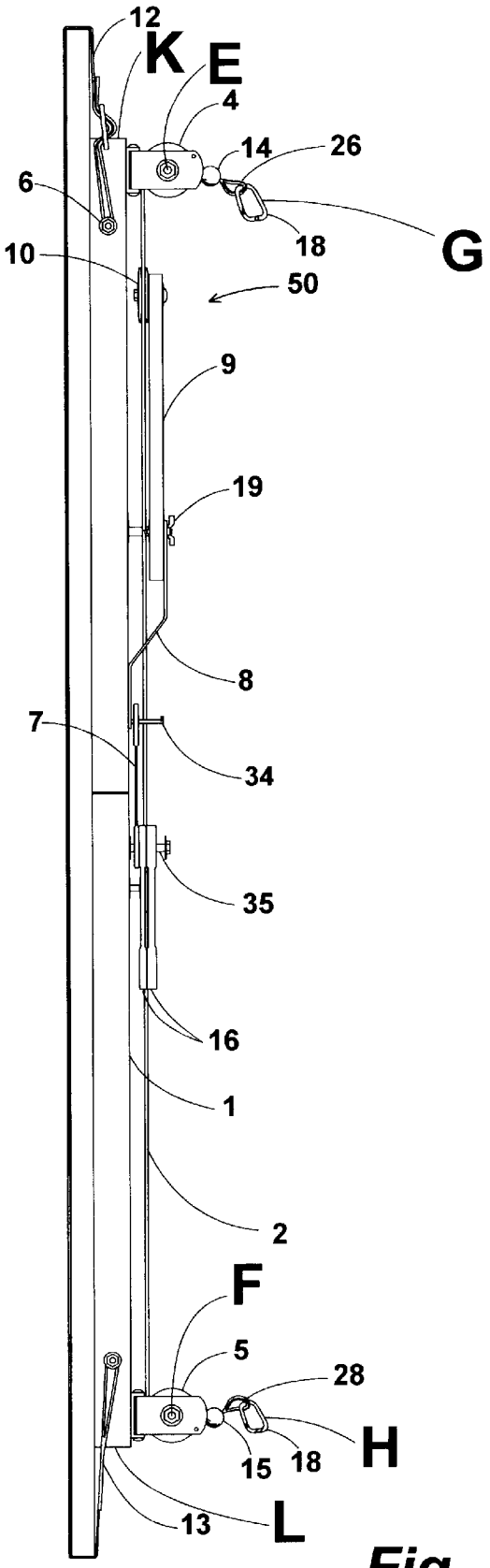
FIG. 3 is a left side surface view of the invention of FIG. 1.
Figure 4:
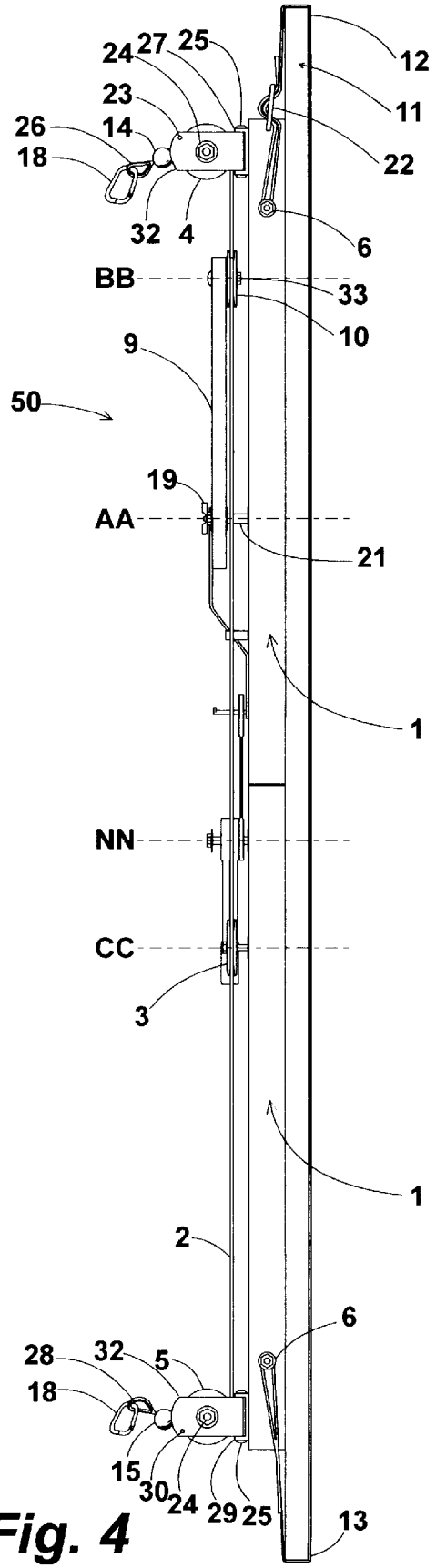
FIG. 4 is a right side surface view of the invention of FIG. 1.
Figure 5:
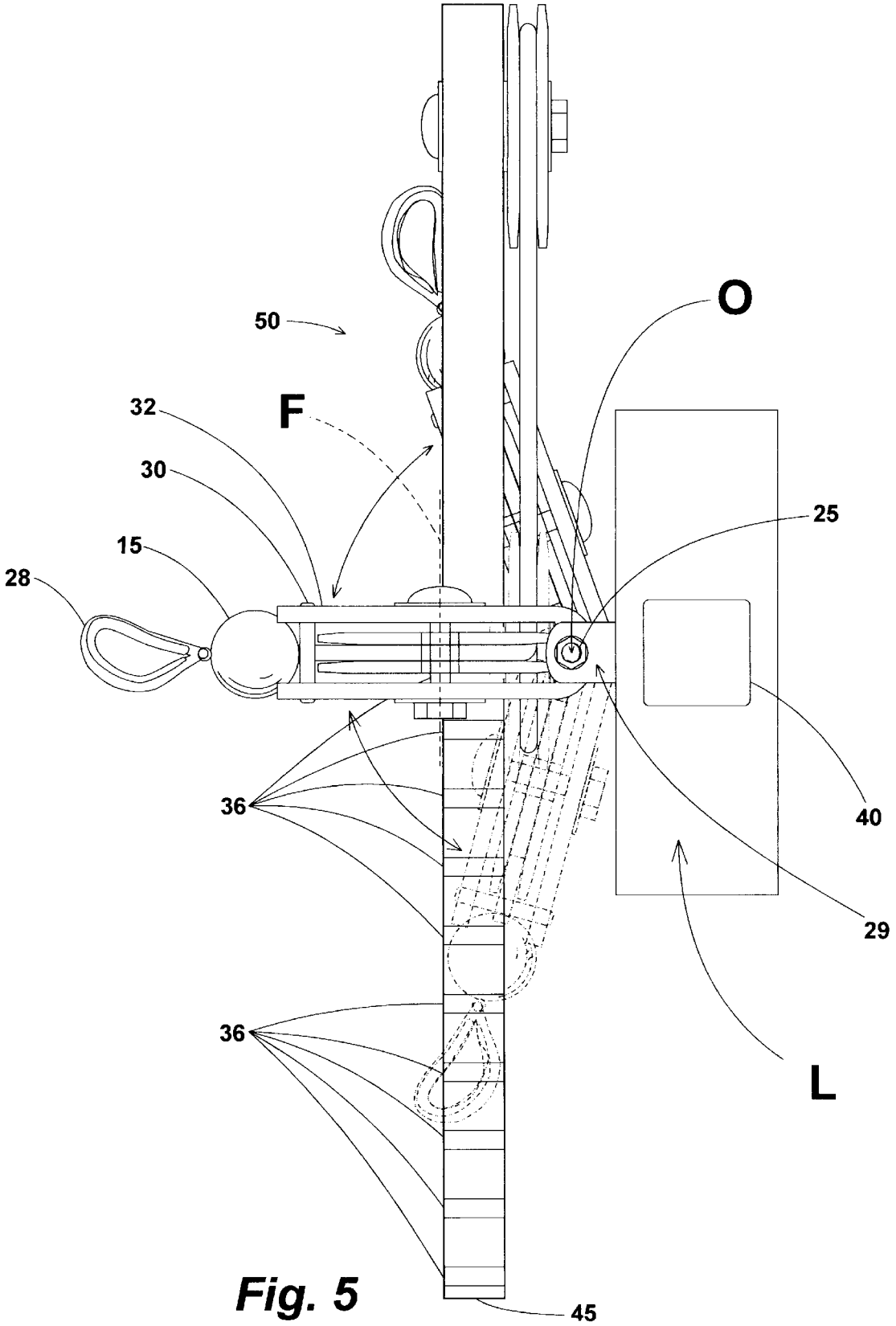
FIG. 5 is a second end surface view of the invention of FIG. 1 illustrating the lever arm member rotated approximately 75 degrees from the setup position.
Figure 6:
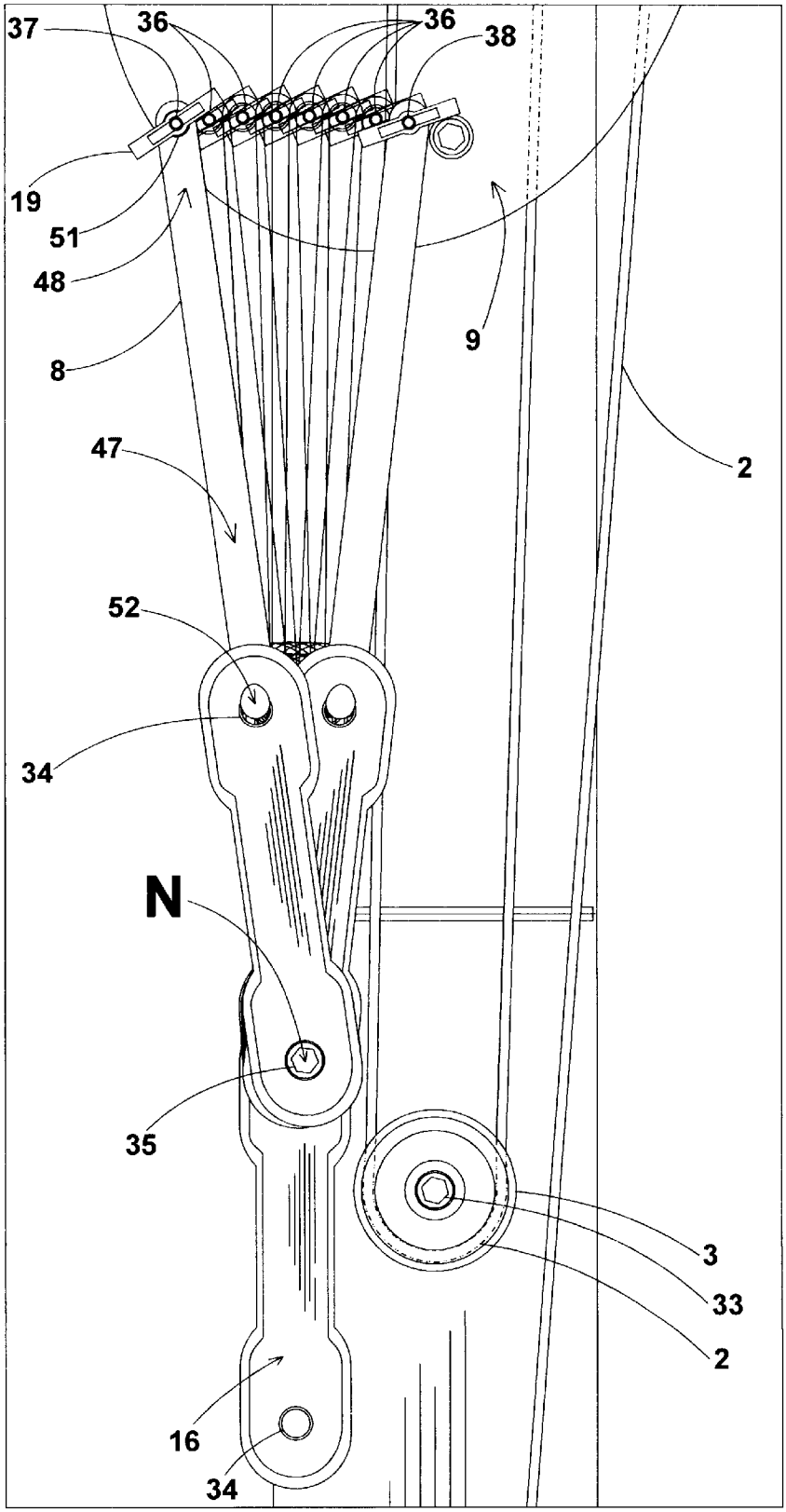
FIG. 6 is a detailed view of the lever-arm member of the invention illustrating the various attachment points of the biasing means.

As seen in FIG. 3, the lever arm member 9 has a lever arm member pulley bolt 33 therethrough proximal to the first end 43 of the lever arm member 9. A lever arm member bolt 21, intermediately located defines axis AA and defines a pivot point A which lever arm member 9 pivots. Lever arm member pulley bolt 33, defines axis BB and mounts pivotally a pulley defined as the lever-arm member pulley 10. The second end 44 of the lever arm bar member has a plurality of holes for attaching means, conveniently apertures 36 which are equidistant spanning the radius from pivot point N on the unit base of the second end of the longitudinally extended biasing means 7 across the lever-arm member second part 42 originating from the pivot point A of the lever-arm member to the second end 44 of the lever arm member. The lever arm member comprises two parts, the portion of the member 9 extending from the pivot point A to and including pivot point B and the first end 43 of the lever arm member 9 defining the first part 41 and the portion of the lever arm member 9 extending from the pivot point A to the second end 44 of the lever arm member 9 defining the second part 42. In a preferred embodiment illustrated in FIGS. 1,2 and 8, it can be seen that the lever arm member 9 is generally flat and elongated from the first end 43 to a second end 44 and has a peripheral edge 45. As seen in FIGS. 1,2,7 and 8, the peripheral edge 45 of lever-arm member 9 defines an ovoid shape, where the lever arm member 9 is egg shaped with one end of the member larger than the other. In other embodiments, member 9 may define other shapes, which will be discussed more fully below.

The unit base 1 has a unit base pulley 3 defined as a pulley pivotally mounted intermediately to the unit base 1, A bolt 33 inserted through the unit base pulley 3 defines axis CC and defines pivot C and attaches the pulley to the unit base 1.

The longitudinally extended cable 2 has a first end 26 with a first end cable stop 14 which is attached to the first end upper horizontal axis pulley 4, extends vertically downward toward the unit base pulley 3, extends vertically upward toward the lever arm member pulley 10, extends downward toward the second end lower horizontal axis pulley 5, extends to the second end cable stop 15 and finally to the second end 28 of the longitudinally extended cable.

A longitudinally extending biasing means 7 has a first end attachment aperture 35 that is pivotally attached at pivot point N to the unit base 3 to which the lever arm member 9, the unit base pulley 3, the first end horizontal axis pulley 4 and the second end horizontal axis pulley 5 are attached, and the second end attachment aperture 34 of the biasing means 7 may be attached to the first end 47 of a biasing extending means 8, which has a second end 48, having a second end attachment 51 through any one of a plurality of apertures 36 formed in the second part 42 of the lever arm member 9. In the embodiment illustrated, the biasing extending means 8, has a first end linking means 52 for the aperture 34 in the biasing means 7. The second end attachment aperture 51 has an attachment means 19, in the embodiment illustrated the attachment means 19 is a spring plunger inserted through the aperture 51 in the second end of the biasing means extender 8 and one of the selected holes 36 in the second part 42 of the lever arm member 9. Of course, in other embodiments, the linking means 52 and the attachment means 19 may be comprised of any well known methods for attaching a strap to a bar, including means which may slide upon the biasing means extender 8 and be clamped thereto.

Figure 1:
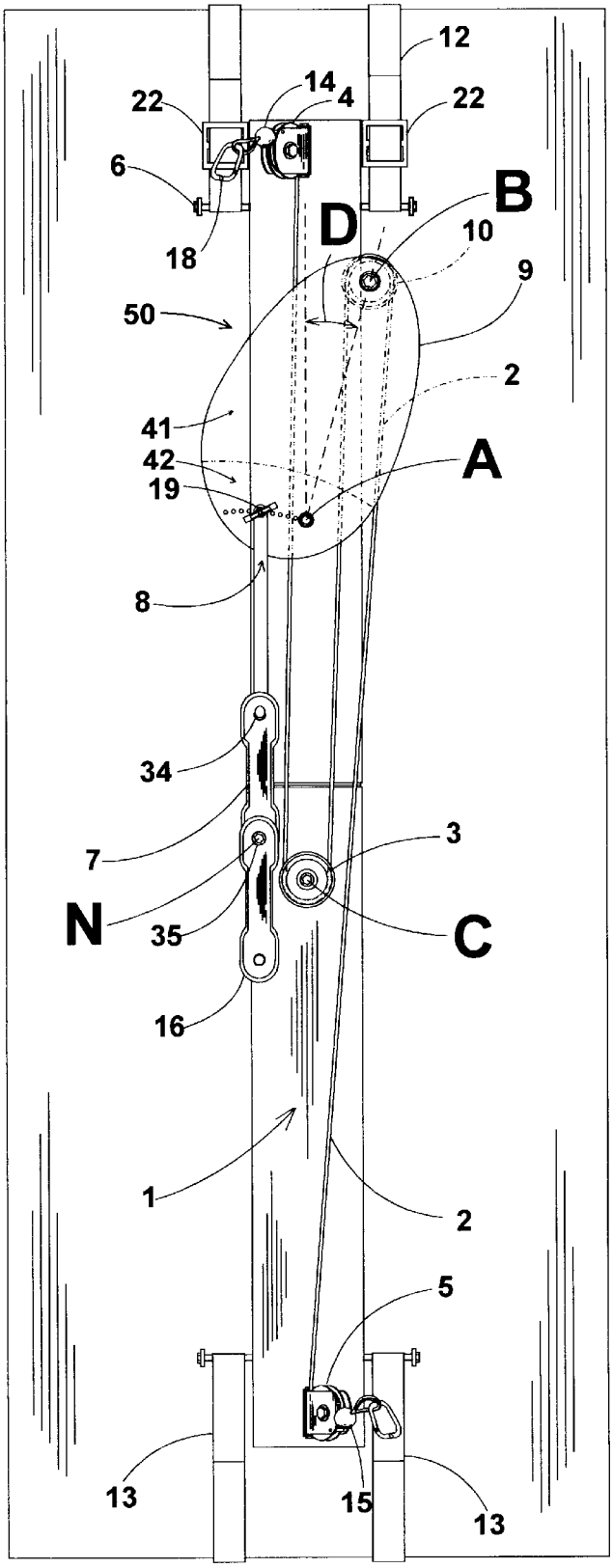
FIG. 1 is a frontal surface elevation view of the invention illustrating attachment of the invention to a door and illustrating the initial setup position of the device.

FIG. 1 illustrates the setup position, the position, the position before tension is taken on the longitudinally extended cable 2 by the exerciser 49. It will be noted that in this preferred embodiment in the setup position, the angle D is approximately 15 degrees, with respect to a longitudinal reference line extending from the first end of the unit base 1 through the lever arm member pivot point A. In the fully extended position, when either the first end G or second end H of the longitudinally extended cable 2 is fully extended, as seen in FIG. 2 and FIG. 3 respectively, the angle D is approximately 10 degrees, that is the longitudinal reference line B is approximately 10 degrees from vertical.

It can be seen in FIG. 7 that as lever arm member 9 pivots about its axis A in the counter-clockwise direction, the moment arm 55 increases in length from the setup position where the moment arm 55(*a*) is short to 55(*d*) where the moment arm is longer. It can also be seen that an opposing (negative) moment arm 54 generated on the opposite side of lever arm member 9, between longitudinally extended cable 2 and axis AA is relatively large in the setup position at 54(*a*) to a small moment arm at 54(*d*). Therefore, initially, the exerciser 49 is working against moment 54(*a*) minus moment arm 55(*a*), and in the fully contracted position, the exerciser is assisted by moment arm 54(*d*) minus moment arm 55(*d*). The decreasing negative moment arm 54 and the increasing positive moment arm 55 compensates for the increasing weakness of the muscles being exercised as they approach full contraction. At the setup position, when the muscles are at full extension and are weaker, the biasing means 7 has not reached its full resistance (including those biasing means that are described as linear) and the resistance force is considerably weaker; therefore, the longer negative moment arm provides additional resistance to overcome a portion of the reduced resistance in the biasing means 7. By overcoming only a portion of the reduced resistance, the resistance is less than at mid-extension of the biasing means 7 to assist the exerciser 49 when the muscles are at full extension. For non-linear biasing means, the exercise device 50 compensates for the increased resistance that is developed by the biasing means 7 as it is stretched so that the force applied by the exerciser 49 may be relatively constant and is reduced as the exerciser 49 reaches the point of a thoroughly complete contraction. Preferably, the lever arm member 9 is sized so that when the second end H of the longitudinally extended cable 2 is fully extended the second end H completes at least 36 inches of travel, to provide the full range of motion necessary for a wide variety of different exercises. In a preferred embodiment, the lever arm member 9 is approximately 21 inches from end to end, 17 inches wide, and the pivot point A is 7 inches from the second end 44. The curvature of the large end is created by a 180 degree arc with a radius of 8 inches about a point that lies along the centerline B extending between the first end 43 and the second end 44 and lies approximately 8 inches from the first end 43. The curvature for the second end 44 is created by a 90 degree arc with a radius of approximately 4.7 inches about a point 4.7 inches along the centerline D from end 44. The sides of lever arm member 9 are formed by a 45 degree arc with a 15 inch radius that is drawn about a center point. These center points are located along a cross line that crosses the centerline D, normal thereto, approximately 8 inches from end 44. The center points for each arc lie 7 inches along the cross line from either side of the centerline B. This is but a preferred configuration for a 60 durometer neoprene elastomeric biasing means that has generally linear resistance characteristics and various other curvatures will create the changing moment arm necessary to oppose the increasing tension created within other biasing means.

In the preferred embodiment, the unit base 1, the lever arm member, the lever-arm member pulley, the unit base pulley, the first end upper horizontal axis pulley, the first end upper horizontal axis pulley bracket, the second end upper horizontal axis pulley and the second end upper horizontal axis pulley bracket are comprised of a generally rigid synthetic resin; however, metal or other suitable materials may be used. The first end upper horizontal axis pulley u-bracket and the second end upper horizontal axis pulley u-bracket are made of metal. The longitudinally extended cable is comprised of vinyl coated braided steel cable; however, nylon or other suitable materials may be used. The biasing means 7 is comprised of an elastomeric band in the preferred embodiment; however, the band may be made from other elastic materials suitable for the purpose. The biasing means 7 may also be comprised of springs or other suitable constructions suitable for the purpose of providing resistance. The biasing means is constructed of a band of elastomeric material that has a resistance of a predetermined number of pound inches based on the amount of resistance required by the individual using the exercise device 50. That is, the device being used by someone just beginning a training program may have a biasing means having 5 pound inches of resistance while a person training for some time may be able to use a biasing means having 200 pound inches.

Having thus set forth a preferred construction for the exercise device 50 of this invention, it is to be remembered that this is but a preferred embodiment. Attention is now invited to a description of the use of the exercise device 50.

The exerciser 49 should select a strong door 11 or platform with a clear area around it to provide sufficient room for storage while mounted to door 11 or attached to a floor platform and to provide sufficient room to complete the exercises. The exerciser 49 having selected an exercise that requires either upward or downward movement mounts or attaches the unit base 1 having the biasing means 7 and the lever arm member 9 mounted thereon, to the door 11 or floor platform. Attached to both sides of the second end of the unit base are door strap brackets which allow straps to be used to encircle any size door for mounting. At the second end of the unit base is a receptacle for use with attachment to a floor platform. As seen in FIG. 8, the exerciser 49 then attaches a grip 17 to either one of the clips 18 located at the first and second end of the longitudinally extended cable 2. The grip 17 may comprise a shaft, as illustrated, a pair of handles or any number of appropriate attachments necessary for a particular exercise. The exerciser then pulls downwardly from the first end (upper) or upwardly from the second end (lower) causing the first end 43 of the lever arm member 9 to pivot clockwise rotating about the bolt 33 so that the biasing means 7 is stretched creating a resistance force. As the first end G or second end H of the cable 2 is pulled by the exerciser, the lever arm member 9 rotates increasing the moment arm 55 and reducing the work effort needed by the exerciser to reach full contraction of the exercised muscles. By reducing the effort required, the exerciser is able to make a thoroughly complete contraction, even though the muscle strength at the flexion position of full contraction is weaker than when the muscles are at a mid-range position of flexion. Different exercises of different muscle groups require a different amount of resistance; therefore, as illustrated in FIG. 8, the exerciser may attach the clip 18 of cable 2, to any one of the holes 36 in the second part 42 of the lever arm member 9. By inserting the plunger 19, that is attached to second end 48 of the biasing means extender 8, in holes closer to the pivot point A, the leverage benefit provided to the exerciser 49 is increased and the force necessary to extend the first end G or the second end H of the cable 2 is reduced. Therefore, by selectively adjusting the point of attachment for the second end 48 of the biasing means 7 with or without the biasing means extender 8 or using multiple biasing means 7, a great number of different resistances may be obtained. In addition, as mentioned before, different and or additional biasing means 16 may be substituted or added that have different ratings of resistance in pounds per inch.

It will, thus, be seen that the objects set forth above among those made apparent from the proceeding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described. All statements of the scope of the invention which, as a matter of language, might be said to fall there between. Now that the invention has been described.

What is claimed is:

1. A dual operational exercise resistance device comprising:

a unit base being configured for attachment to support means, comprising a frontal surface, said frontal surface having a first end and a second end, a rear surface, said rear surface having a first end and a second end, a left side surface, a right side surface, a first end surface and a second end surface, the said second end surface having a hole for attachment to a support, said unit base having a first end and a second end;

a unit base pulley pivotally attached intermediately on the said unit base;

a lever arm member having a peripheral edge, said lever arm member being pivotally attached to the unit base at a pivot point intermediate first and second ends of said lever arm member, said pivot point defining a first part of said lever arm member extending from said pivot point to and including said first end of said lever arm member and a second part of said lever arm member extending from said pivot point and including said second end of said lever arm member;

a lever-arm pulley pivotally attached proximal to the said first end of said lever arm member;

a longitudinally extending biasing means having first and second ends, said first end being connected to said unit base and said second end of said biasing means being attached to said second part of said lever arm member;

a first end horizontal axis pulley being attached to a vertical axis pulley block attached to a vertical mounted u-bracket being attached proximal to said first end of said unit base;

a second end horizontal axis pulley being attached to a vertical axis pulley block attached to a vertical mounted u-bracket being attached proximal to said second end of said unit base; and a longitudinally extended cable having a first end and a second end, said first end attached to a first end cable stop, said second end attached to a second end cable stop, engaging a portion of said first end horizontal axis pulley, engaging a portion of said unit base pulley, engaging a portion of said lever-arm pulley, engaging a portion of said second end horizontal axis pulley, extending to said second end cable stop, extending to said second end of said longitudinally extended cable.

2. A dual operational exercise resistance device as in claim 1 wherein said peripheral edge of said member defines an ovoid shape on a plane passing through said peripheral edge of said member.

3. A dual operational exercise resistance device as in claim 2 wherein said ovoid shape of said member defines a larger end generally opposing a smaller end and said larger end is said first end of said member.

4. A dual operational exercise resistance device as in claim 1 wherein said lever arm member comprises a plurality of attaching means spaced apart from one another, said second end of said biasing means being selectively attachable to one of said plurality of attaching means.

5. A dual operational exercise resistance device as in claim 1 wherein said biasing means comprises an elastomeric band.

* * * * *